US006157013A

United States Patent [19]

Casagrande et al.

[11] Patent Number: 6,157,013

[45] Date of Patent: Dec. 5, 2000

[54] MICROWAVE APPLICATOR AND METHOD FOR THE SURFACE SCARIFICATION OF CONTAMINATED CONCRETE

[75] Inventors: Benoît Casagrande, Etrechy; Jean Pierre Furtlehner, Jouy-en-Josas, both of France

[73] Assignee: Commissariat a l'Energie Atomique, Paris, France

[21] Appl. No.: 09/355,300

[22] PCT Filed: Jan. 29, 1998

[86] PCT No.: PCT/FR98/00165

§ 371 Date: Jul. 28, 1999

§ 102(e) Date: Jul. 28, 1999

[87] PCT Pub. No.: WO98/34435

PCT Pub. Date: Aug. 6, 1998

[30] Foreign Application Priority Data

Jan. 31, 1997 [FR] France ..... 97 01102

[51] Int. Cl.[7] ..... H05B 6/72; H05B 6/80

[52] U.S. Cl. ..... 219/690; 219/695; 219/748; 219/762; 219/746; 219/679; 588/900; 422/186

[58] Field of Search ..... 219/690, 679, 219/680, 745, 746, 748, 756, 762, 695; 588/900; 422/186

[56] References Cited

U.S. PATENT DOCUMENTS

| | | | |
|---|---|---|---|
| 3,102,181 | 8/1963 | Verstraten | 219/748 |
| 5,003,144 | 3/1991 | Lindroth et al. . | |
| 5,283,010 | 2/1994 | Waring . | |
| 5,449,889 | 9/1995 | Samardzija | 219/695 |
| 5,877,395 | 3/1999 | Emery | 219/690 |
| 6,013,330 | 1/2000 | Lutz | 427/511 |

FOREIGN PATENT DOCUMENTS

| | | |
|---|---|---|
| 0 438 179 A1 | 7/1991 | European Pat. Off. . |
| 3-002595 | 1/1991 | Japan . |
| 3-148592 | 6/1991 | Japan . |
| 8-304597 | 11/1996 | Japan . |
| WO 95/00681 | 1/1995 | WIPO . |

*Primary Examiner*—Philip H. Leung
*Attorney, Agent, or Firm*—Anderson, Kill & Olick P.C.

[57] ABSTRACT

The applicator directs microwaves through a guide (5) and housing to focus microwaves generated from a microwave emitter to the surface of a target of contaminated concrete. The housing (4) of the applicator has a elliptical base and a truncated elliptical section with two focal areas (F1) and (F2). A component (11) is arranged at the focal area (F1) in the direction of the waveguide to diffuse incident waves to a wall of the housing where they are reflected to the focusing area (F2).

10 Claims, 4 Drawing Sheets

MICROWAVE APPLICATOR AND METHOD FOR THE SURFACE SCARIFICATION OF CONTAMINATED CONCRETE

DESCRIPTION

The invention pertains to a micro-wave applicator and method for the surface scarification of contaminated concrete.

The dismantling of used nuclear installations involves the destruction of the contaminated equipment and in particular its breaking up into pieces which are then put into drums of bitumen that are stored in specialized installations. Concrete walls that must be subjected to this breaking up treatment pose a particular problem however because of their thickness: since the contamination is absorbed into the surface layers of the concrete, the heart of the concrete remains clean and no special treatment can be justified for it.

The interest in not excessively increasing the volume of material to be stored has lead the industry to separate the contaminated layer from the remainder of the concrete walls by techniques called "crust removal" techniques and which consist of carrying out surface scarification of the concrete walls which leaves the clean heart of the concrete in place but detaches the contaminated layer. A number of purely mechanical tools have been used to do this such as bush hammers, pneumatic picks and pressurized water jets as well as the application of micro-waves. This new technique makes use of the presence of water in the concrete, which is heated by the micro-waves so that it boils and explodes within the solid material. This produces the desired scarification.

The correct implementation of the method rests however on suitably choosing certain parameters such as the power of the micro-waves, their frequency their area of application and their direction. In an apparatus described in the article "Microwave system for the removal of concrete surface layers" by P. Corleto and co-workers and published by the Italian Agency for New Technologies for Energy and the Environment (ENEA), several high power magnetrons were used to emit micro-waves spread out over a large surface area. Hence a large volume of concrete was heated all the more since the micro-waves, whose frequency was relatively low at 2450 MHz in the equipment proposed, penetrated more deeply into the concrete. This apparatus appears to be effective, but one may suppose that other ways of proceeding would also be suitable, ways which allow one to remove the crust from the same area of concrete while using much less power so as to prevent the divergence of the microwaves which leads to a reduction in the power per unit volume deposited in the concrete and eventually to decreased efficiency of the method. This invention has been designed to take account of these considerations and its essential characteristic consists in that the microwaves are focused onto a more or less limited or more or less slender area, within which the heating is concentrated, and which determines the depth of the crust removed once the focusing area has been stabilized.

The known equipment for removing the concrete crust have an appliance that includes a head through which the microwaves leave a waveguide. This application head, placed on the concrete wall or positioned at a small distance from it, must therefore be designed to create the desired focus. Although the focusing of waves does not appear to have been proposed in the technique we are concerned with, it is known that appliances have been developed for medical purposes to focus microwaves and to create localized hyperthermia in the body of a patient, for example to destroy a tumor at the focal point. Three different pieces of equipment are described in the articles "A Direct Contact Microwave Lens Applicator with a Microcomputer Controlled Heating System for Local Hyperthermia" by Nikawa and others (IEEE Transactions on Microwave Theory and Techniques, Vol. MTT-34, No. 5, May 1986), "An Electric Field Converging Applicator with Heating Pattern Controller for Microwave Hyperthermia" again by Nikawa and others (same source) and "Microwave Applicator using Two Slots on Sphere" by Krairiksh and others, published by IEEE and presented at the Asia-Pacific Microwave Conference at Adelaide in 1992. One of these pieces of equipment includes a convergent lens at the waveguide outlet. Another includes a waveguide providing a final broadening and which is divided at that place by parallel plates which are exposed to a beam of microwaves made divergent on entering the broadening section. Wave reflections produced at the parallel plates make the beam convergent and focused at the applicator outlet. Finally a third carries a hemispherical application head from which the microwaves leave through the slots in an arc of a circle. Satisfactory focusing is provided by these systems, but for removing the crust from concrete another kind is desirable since these application heads with an opening of large surface area can be easily damaged by the dust and debris detached from the scarified concrete. It should be noted that the large openings also imply a loss of efficiency since the proportion of microwaves reflected by the concrete to the outside and which are therefore lost, is greater.

The essential objective of the invention is therefore an applicator having a head made up of a housing fitted with an outlet opening for the microwaves, which allows a beam of microwaves to be focused on a target with good sharpness, without the structure being complicated and without the opening being large.

Since the main application envisaged of removing a concrete crust requires wide ranging treatment of walls of extended area which will involve large expenditures of energy, it is desirable to restrict microwave leakage at the applicator outlet and above all microwave reflections returning into the waveguide, in the direction of the microwave producing apparatus which could then easily be damaged.

These various problems have been resolved with an applicator comprising a waveguide and a head in which this waveguide terminates, the head having an opening directed towards a target for the microwaves and which essentially comprises a housing which reflects the microwaves. Two main variants are proposed which provide the common original element that the housing is a surface with a truncated elliptical section and has two focal areas, one of which situated outside the opening is the focal point for the microwaves. The other focal area is a place for dispersion of microwaves coming from the waveguide towards the surface of the housing where the microwaves are reflected to converge towards the focusing area. In one of the variants, the focusing area for dispersion is occupied by a component that reflects the microwaves and the waveguide is directed towards this component, which can be spherical, cylindrical or with the shape of a dihedral at an angle directed towards the waveguide. In the other embodiment, there is no reflection to the internal focal area, but diffusion of the microwaves which leave the waveguide at this place. A diffusing component equipped with multiple slots in which the waveguide ends can be provided.

The main application envisaged is therefore the removal of a contaminated concrete crust, but it is not the only application and the invention could find uses in the grinding of stones or in medicine.

The invention will now be described with the help of the following figures, which give some examples of its implementation:

Figure 1:
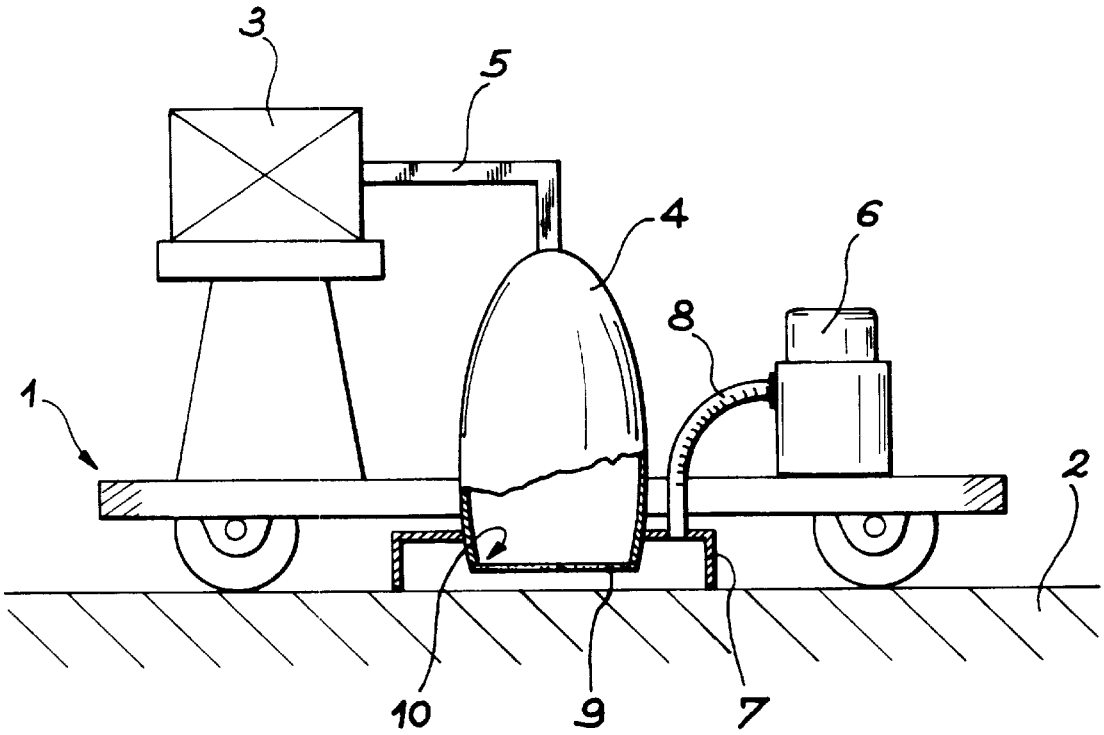
FIG. 1 represents a general view of the invention

The apparatus can be mounted on a carriage 1 that moves over the concrete wall 2 which is to have its crust removed; it comprises a microwave generator 3, an application head 4, a waveguide 5 linking the two preceding components, an aspirator 6, an aspiration dish 7 surrounding the end of the application head 4, an aspiration pipe 8 that ends in the dish 7, and if the need arises a membrane 9 that blocks the opening 10 of the application head 4. The microwaves originating from the emitter 3 pass through the waveguide 5 and leave the application head 4 through the opening 10, placed directly on the wall 2 or at a very small distance from it so as to restrict leakage; the optional membrane 9 is used to protect the interior of the application head 4 from dust and debris produced by the crumbling of the concrete, but obviously it is permeable to the microwaves. The dust and the debris go up into the dish 7 and are aspirated by the aspirator 6.

Figure 2:
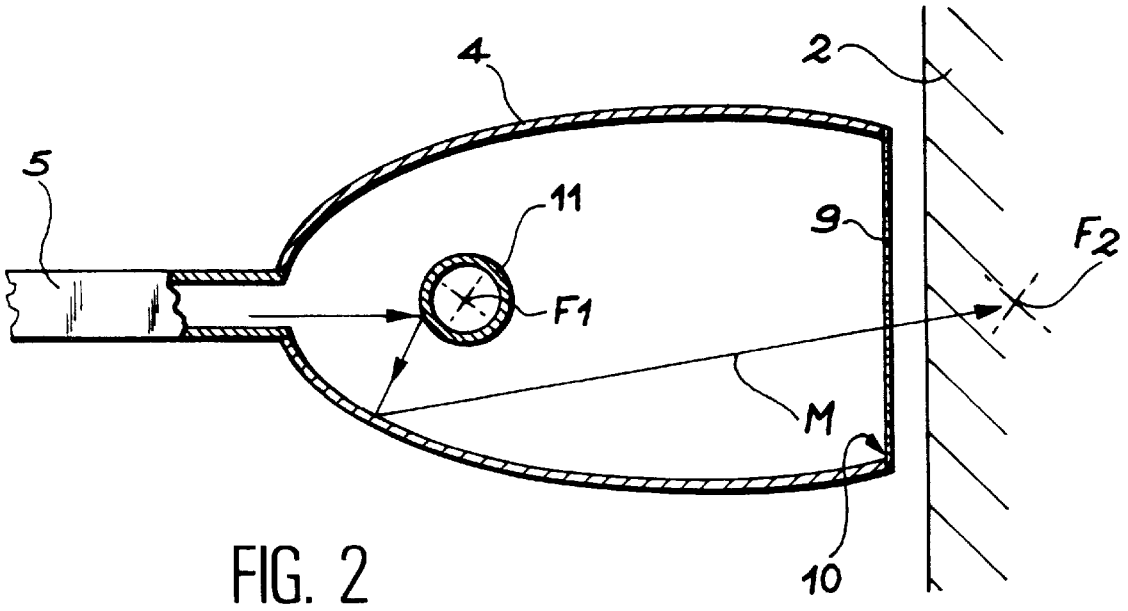
FIG. 2 represents a first design of the applicator
Figure 3:
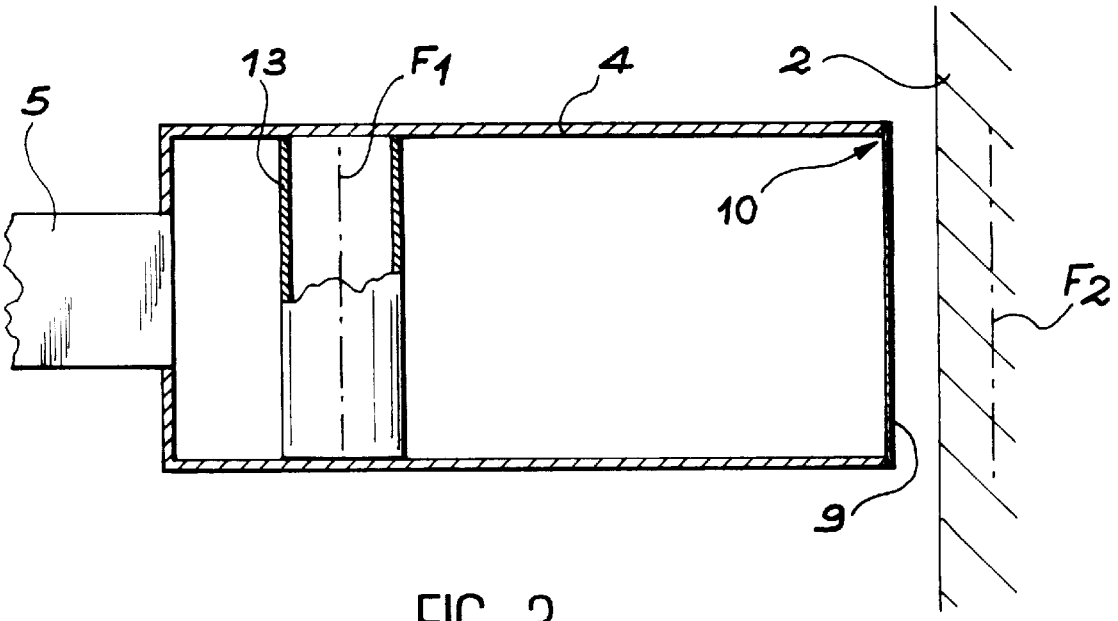
FIG. 3 illustrates another view of this design of the applicator

Referring to FIGS. 2 and 3, it can be seen that the application head 4 is a housing with the shape of a truncated cylinder with an elliptical base or an ellipsoidal cylinder, which includes two focal areas F1 and F2 and in which the truncation is such that the second focal area F2 is situated outside the housing, beneath the surface of the concrete wall 2. The waveguide 5, which can be formed by a metal sheath of rectangular cross section, has a plane of symmetry which coincides with the plane that links the focal areas F1 and F2 of the ellipsoidal cylinder. The first area F1, situated within the housing, is occupied by a reflector 11, in this case formed by a metal cylinder connected to the application head 4. The waves M, the path of one being shown by arrows, leave the waveguide 5 parallel to the plane of symmetry of the housing and are then reflected by the reflector 11 to the surface of the application head 4, which reflects them in its turn to the focal area F2 whatever their initial path and in particular their point of reflection on the reflector 11: the focusing is almost perfect, thanks to the geometric properties of the ellipsoidal cylinder and it is only spoiled by the diameter of the reflector 11 not being zero, which prevents reflection at the first focal area F1 itself. The second focal area F2 is, in reality positioned a little deeper in the concrete wall 2 than is shown, because of the refraction of the waves produced at the interface between the air and the concrete. The air-concrete interface also causes reflections of waves in all directions, in particular towards the waveguide 5 and towards the outside. The first of these however does not have a damaging effect since the reflector 11 stops the greater part of them and therefore protects the waveguide 5; and the second of these is reduced because of the contracted aspect of the opening 10.

The interesting feature of the housing in the shape of a cylinder with an elliptical base is that it can be given a width significantly greater in the direction that is transverse to its movement 1, so as to spread the heating effect over a bigger width of concrete and scarify it along broader bands. FIG. 3 shows that the focal areas F1 and F2 are linear and have the appearance of segments parallel to the axis of the reflector 11 in an ellipsoidal cylinder, and that the focal area F2 represents the width of the band on the concrete that is heated. The rectangular waveguide 5 has a section, the larger side of which is parallel to the transverse direction in order to emit the waves over a greater width.

Figure 4:
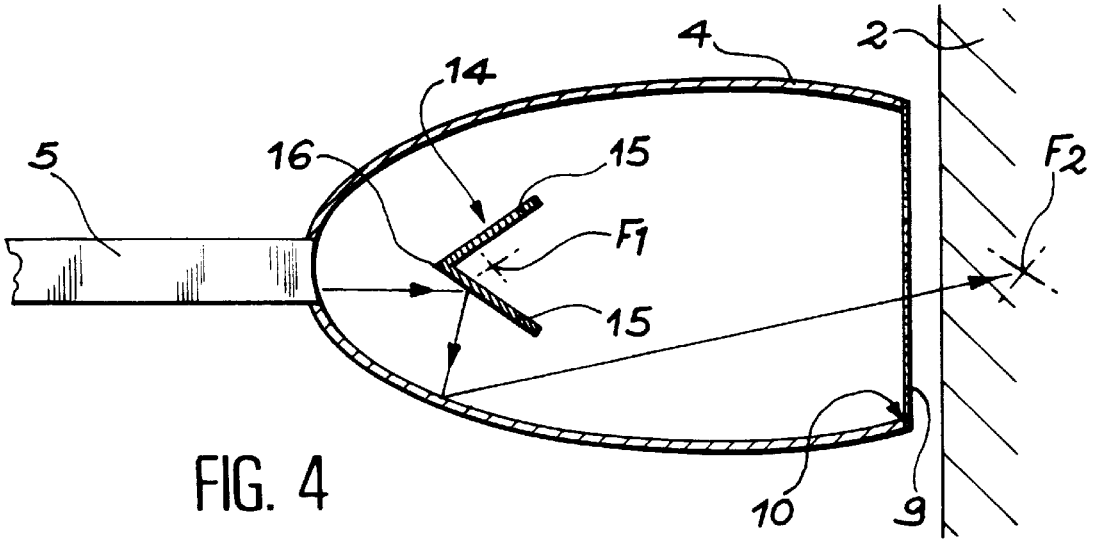
FIG. 4 illustrates a second design of the applicator
Figure 5:
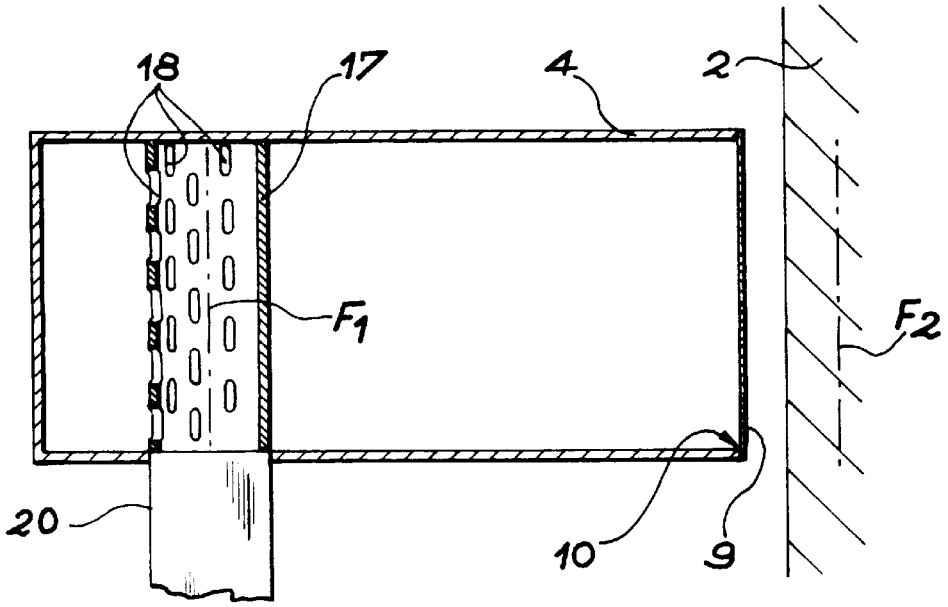
FIG. 5 illustrates a third design of the applicator

However as the cylindrical reflector 11 has the disadvantage of sending back part of the radiation which is in practice coincident with the large axis of the ellipse towards the waveguide 5, which could damage the emitter 3, it could be advisable to replace it with the dihedral shape 14 in FIG. 4, made up of two flat facets 15 linked by an angle 16 directed towards the waveguide 5 and opening out towards the opening 10. In this way reflections normal to the waveguide 5 which are reflections which are dangerous for the emitter, are prevented. The disadvantage of the dihedral shape 14 is however that it focuses the radiation towards the second focal point F2, less well.

Yet another design can be proposed, in which the waveguide 5 coaxial with the application head 4 is replaced by a waveguide 20 coaxial with the first focal area and situated in its extension. The waveguide 20 extends into the inside of the housing and has the appearance of a tube 17 pierced with fine radial slots 18 extending along its length and distributed over a large part of its surface, except towards the opening 10. The waves leave the tube 17 in all directions starting from the first focal point F1. As in the preceding embodiments, they are reflected from the internal surface of the application head 4 towards the second focal area F2. As the wave path remains the same as previously from the first focal area F1, the operation of the equipment remains the same.

Figure 6:
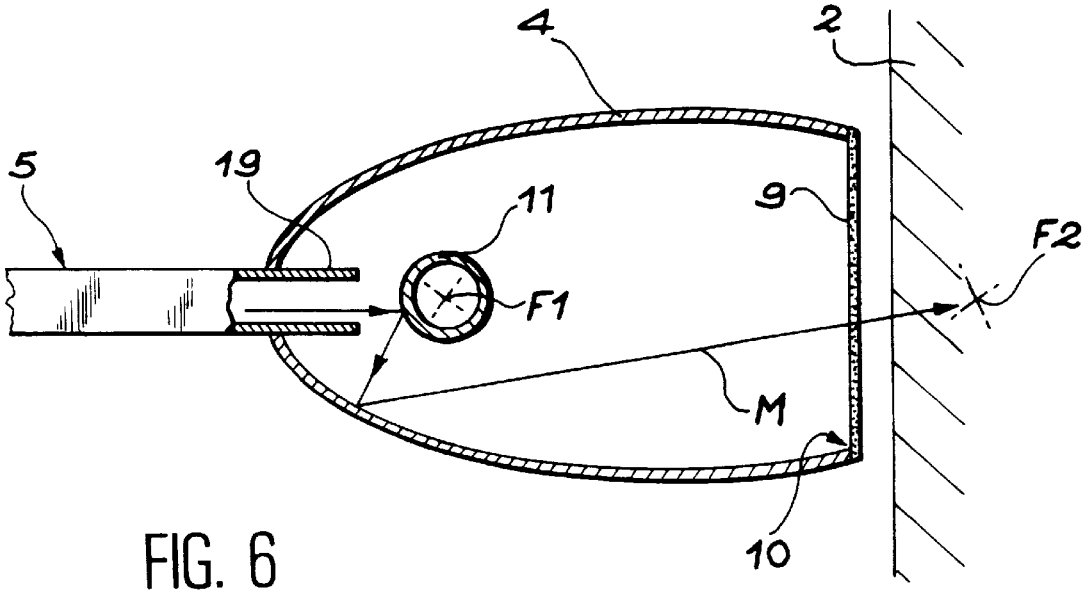
FIGS. 6 and 7 illustrates variants of the embodiments in FIGS. 2 and 4.
Figure 7:
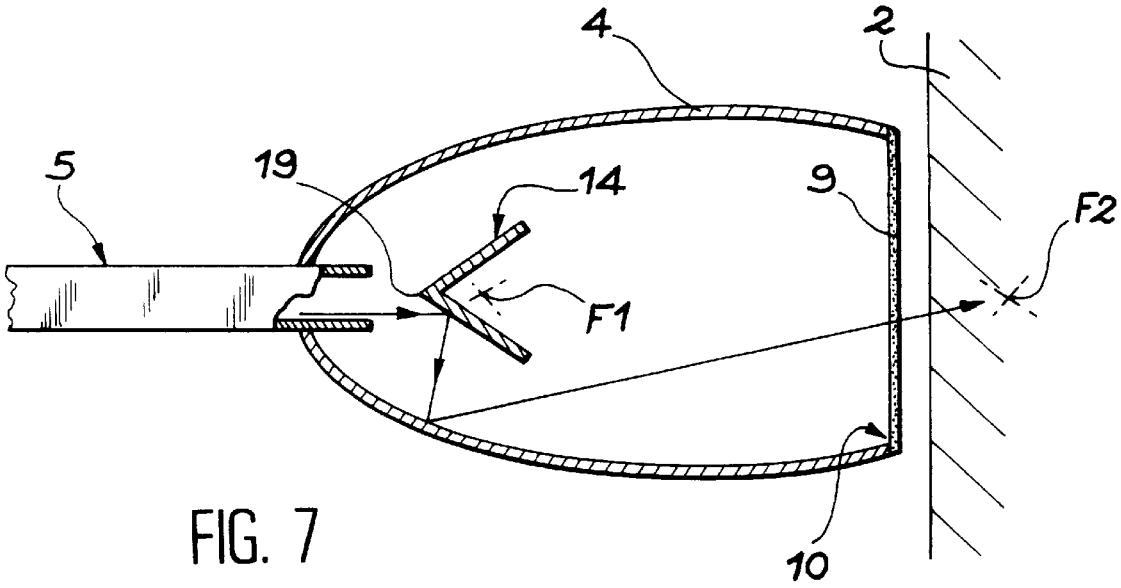

The ellipsoid of the application head 4 can have a transverse dimension more or less large: the preceding Figures have illustrated the case of wide application heads 4, a reflector 11, 14 or 17 that is lengthened transversely and with linear focal areas F1 and F2; application heads with rotational symmetry can also be chosen, the focal areas being then replaced by restricted focal points; the reflective component will be a sphere or a cone which will replace the cylinder 11 or the dihedral shape 14, and it will be linked to the application head 4 by suspension arms; the drawings in FIGS. 2 and 4 then remain valid, all the sections of the application head then having a truncated elliptical section FIGS. 6 and 7 finally illustrate variants to the embodiments in FIGS. 2 and 4, which are distinguished in that the waveguide 5, instead of emerging at the internal surface of the housing of the application head 4, comprises an extension 19 which disappears into the chamber surrounded by the application head 4 towards the focal area F1; the extension ends at a distance that is advantageously close to a quarter of the wavelength of the microwaves. It has been observed that this arrangement gives good focusing results thanks to the longer guidance for the microwaves. It has also been observed that it was advantageous that the reflector 11 or 14 has a small size roughly equal to a quarter of the wavelength. These values are however approximate and result from empirical tests, so that other good solutions, indeed better solutions may exist in particular cases notably in relation to the shape of the reflector.

What is claimed is:

1. A microwave applicator for focusing microwaves generated from a microwave emitter, said applicator comprising a waveguide (5) and a head (4) in which the waveguide terminates, the head having an opening (10) directed towards a target (2) for the microwaves and essentially comprising a housing that reflects the microwaves, characterized in that the housing is of a truncated elliptical section having two focal areas, one of the focal areas (F1), towards which the waveguide is directed, being occupied by a component (11) that reflects the microwaves and the other of the focal areas (F2) being situated outside the opening.

2. A microwave applicator according to claim 1, characterized in that the component that reflects the microwaves is spherical.

3. A microwave applicator according to claim 1, characterized in that the component that reflects the microwaves is cylindrical (11).

4. A microwave applicator according to claim 1, characterized in that the component that reflects the microwaves has a dihedral shape (14) with an angle directed towards the waveguide.

5. A microwave applicator according to claim 1, characterized in that the component that reflects the microwaves is a cone.

6. A microwave applicator according to claim 1, characterized in that the waveguide (5) emerges at an internal surface of the housing that reflects the microwaves.

7. A microwave applicator according to claim 1, characterized in that the waveguide (5) comprises an extension (19) into the housing that reflects the microwaves and which ends at a distance close to a quarter of the wavelength of the microwaves from the focal area (F1) occupied by the component that reflects the microwaves.

8. A microwave applicator for focusing microwaves generated from a microwave emitter, said applicator comprising a waveguide (20) and a head (4) in which the waveguide terminates, the head having an opening (10) directed towards a target (2) for the microwaves and essentially comprising a housing that reflects the microwaves, characterized in that the housing is of a truncated elliptical section having two focal areas, one of the focal areas (F1), at which the waveguide terminates, being occupied by a component (17) that diffuses the microwaves and the other of the focal areas (F2) being situated outside the opening (10).

9. A microwave applicator according to claim 8, characterized in that the component that diffuses the microwaves is a component cut with slots (18) and in which the waveguide (15) ends.

10. A method for focusing microwaves generated from a microwave emitter at the surface of a target of contaminated concrete comprising the steps of:

directing the microwaves through a waveguide towards the surface of said target;

terminating the waveguide in a housing having an opening facing the target and a truncated elliptical section with two focal areas (F1) and (F2) with the focal area (F1) disposed in the direction of the microwaves emitted from said waveguide and with the focal area (F2) forming a focal point for the microwaves outside the opening adapted to lie beneath the surface of the target of contaminated concrete and;

interposing a member in the housing at the focal area (F1) to cause incident microwaves to be reflected or diffused in the direction of the housing so that the microwaves converge at the focal area (F2) to cause surface scarification of the contaminated concrete.

* * * * *